US005658189A

United States Patent [19]

Kagamida

[11] Patent Number: 5,658,189

[45] Date of Patent: Aug. 19, 1997

[54] GRINDING APPARATUS FOR WAFER EDGE

[75] Inventor: Takeshi Kagamida, Mitaka, Japan

[73] Assignee: Tokyo Seimitsu Co., Ltd., Tokyo, Japan

[21] Appl. No.: 527,348

[22] Filed: Sep. 12, 1995

[30] Foreign Application Priority Data

Sep. 29, 1994 [JP] Japan ..... 6-235179

[51] Int. Cl.[6] ..... B24B 7/04; B24B 9/06

[52] U.S. Cl. ..... 451/66; 451/44; 451/194; 451/210; 451/254

[58] Field of Search ..... 451/43, 44, 57, 451/58, 65, 66, 123, 134, 140, 194, 195, 210, 254, 255, 256, 258, 398

[56] References Cited

U.S. PATENT DOCUMENTS 2,293,291 8/1942 Gaspari ..... 451/255
5,056,270 10/1991 Curcher ..... 451/255 X
5,097,630 3/1992 Maeda et al. ..... 451/210 X

FOREIGN PATENT DOCUMENTS 2481634 11/1981 France ..... 451/256
1271156 10/1989 Japan ..... 451/255
2 236 970 4/1991 United Kingdom .

*Primary Examiner*—Timothy V. Eley
*Attorney, Agent, or Firm*—Sixbey, Friedman, Leedom & Ferguson, P.C.; David S. Safran

[57] ABSTRACT

A slide table is slidably supported on the slide stage which is moved by a guide screw. The slide table is connected with the slide stage by means of pressurization means. A rotatable wafer table is provided on the slide table. A grinding wheel for chamfering is used. The pressurization means is locked, so that the slide table is kept locked to the slide stage. A wafer set on the slide table is moved toward the grinding wheel, and an edge of the wafer is chamfered. A grinding wheel for polishing is used. The pressurization means is not locked, so that the slide table can be slide on the slide stage. A wafer set on the slide table is moved toward the grinding wheel, and an edge of the wafer is polished.

6 Claims, 6 Drawing Sheets

GRINDING APPARATUS FOR WAFER EDGE

BACKGROUND OF THE INVENTION

1. Field of the Invention

This invention relates to a grinding apparatus for an edge of a silicon wafer, etc., which are materials for a semiconductor element, and more particularly to a grinding apparatus for an edge of a silicon wafer, which carries out chamfering and polishing for the wafer edge.

2. Description of the Related Art

A silicon ingot, etc., which are materials for a semiconductor element, are sliced into wafers by a slicing machine. Because the outer peripheral of the wafer has an edge (the outer peripheral surface of the wafer is substantially perpendicular to a cutting face), clippings and cracks easily appear due to a little shock on the outer peripheral part of the wafer. That is why the wafer having been sliced by the slicing machine is chamfered before the lapping with a lapping machine. And, recently, because of the high integration of the wafer, not only the chamfering for the wafer edge but also the polishing for the chamfered wafer is performed.

Conventionally, the chamfering and the polishing are respectively carried out in different apparatuses. There is a chamfering apparatus which is modified to perform the polishing as well as the chamfering, but this apparatus uses a forming urethane, etc. instead of a grindstone. A mechano-chemical abrasive, a mixture of caustic soda (poison) and a powder silica, which are difficult to handle, instead of widely-used water soluble coolant. However, in the case when the chamfering and the polishing for the wafer are performed in different apparatuses, there is a problem in that the cost of equipment is high and a large space is required.

Moreover, the mechano-chemical abrasive is employed in the chamfering apparatus which is modified to perform the polishing. Therefore, there is a problem in that the abrasive cannot be easily handled. Further, some equipments are required for a special equipment for supplying abrasive.

SUMMARY OF THE INVENTION

The present invention has been developed under the above-described circumstances and has as its aim the provision of a grinding apparatus for a wafer edge, which is capable of performing the chamfering and the polishing in one apparatus and carrying out the polishing with wafer soluble coolant that can be easily handled.

To achieve the above-described object, a grinding apparatus for a wafer edge comprises grinding means which rotates a chamfering grinding wheel or polishing grinding wheel for an edge of a wafer, and moves the chamfering or polishing grinding wheel up to a position at which the edge of the wafer is to be chamfered or polished, a stage moving toward and backward from the grinding means, rotating means for rotating the wafer being fixed thereon, which is supported on the stage in such a manner to be slidable along a movement direction of the stage and moves together with the stage up to a position at which the edge of the wafer is to be chamfered or polished, pressurization means for pressing the wafer against the polishing grinding wheel with a prescribed pressure by applying a force to the rotating means, and locking means for locking the pressurization means so as to prevent the force of the pressurization means from acting on the rotating means.

Further, a grinding apparatus for a wafer edge comprises first grinding means which rotates a chamfering grinding wheel for an edge of a wafer, and moves the chamfering grinding wheel up to a position at which the edge of the wafer is to be chamfered, second grinding means which rotates a polishing grinding wheel for an edge of a wafer, and moves the polishing grinding wheel up to a position at which an the edge of the wafer is to be polished, a stage moving toward and backward from the grinding means, rotating means for rotating the wafer being fixed thereon, which is supported on the stage in such a manner to be slidable along a movement direction of the stage and moves together with the stage up to a position at which the edge of the wafer is to be chamfered or polished, pressurization means for pressing the wafer against the polishing grinding wheel with a prescribed pressure by applying a force to the rotating means, and locking means for locking the pressurization means so as to prevent the force of the pressurization means from acting on the rotating means.

According to the present invention, a rotatable wafer table on which a wafer is set and a rotatable grinding wheel are relatively moved in vertical and horizontal directions, so that an edge of a wafer is chamfered and polished. A pressurization means generates a pressure to press the wafer against the grinding wheel. A locking means locks the pressurization means so as not to generate the pressure. At the time of performing a chamfering for the edge of the wafer, a grinding wheel for chamfering is used as the grinding wheel, the wafer table on which a wafer is set and a grinding wheel are relatively moved in vertical and horizontal directions while the pressurization means is locked by the locking means, so that the chamfering for the edge of the wafer can be performed. At the time of performing the polishing for the edge of the wafer, a grinding wheel for polishing is used as the grinding wheel, the wafer table on which a wafer is set and a grinding wheel relatively are moved in vertical and horizontal directions while the pressurization means is not locked. That is, the wafer is pressed against the grinding wheel for polishing with a prescribed pressure by means of pressurization means, so that the polishing for the edge of the wafer can be performed.

As a result, the chamfering and the polishing can be performed in one apparatus.

Moreover, in the present invention, the ordinary grinding wheel for polishing is used at the time of the polishing, therefore, a widely-used water soluble coolant can be applied instead of special abrasive.

DESCRIPTION OF THE PREFERRED EMBODIMENT

Detailed description will hereunder be given of the preferred embodiment of a grinding apparatus for a wafer edge according to the present invention with reference to the accompanying drawings.

Figure 1:
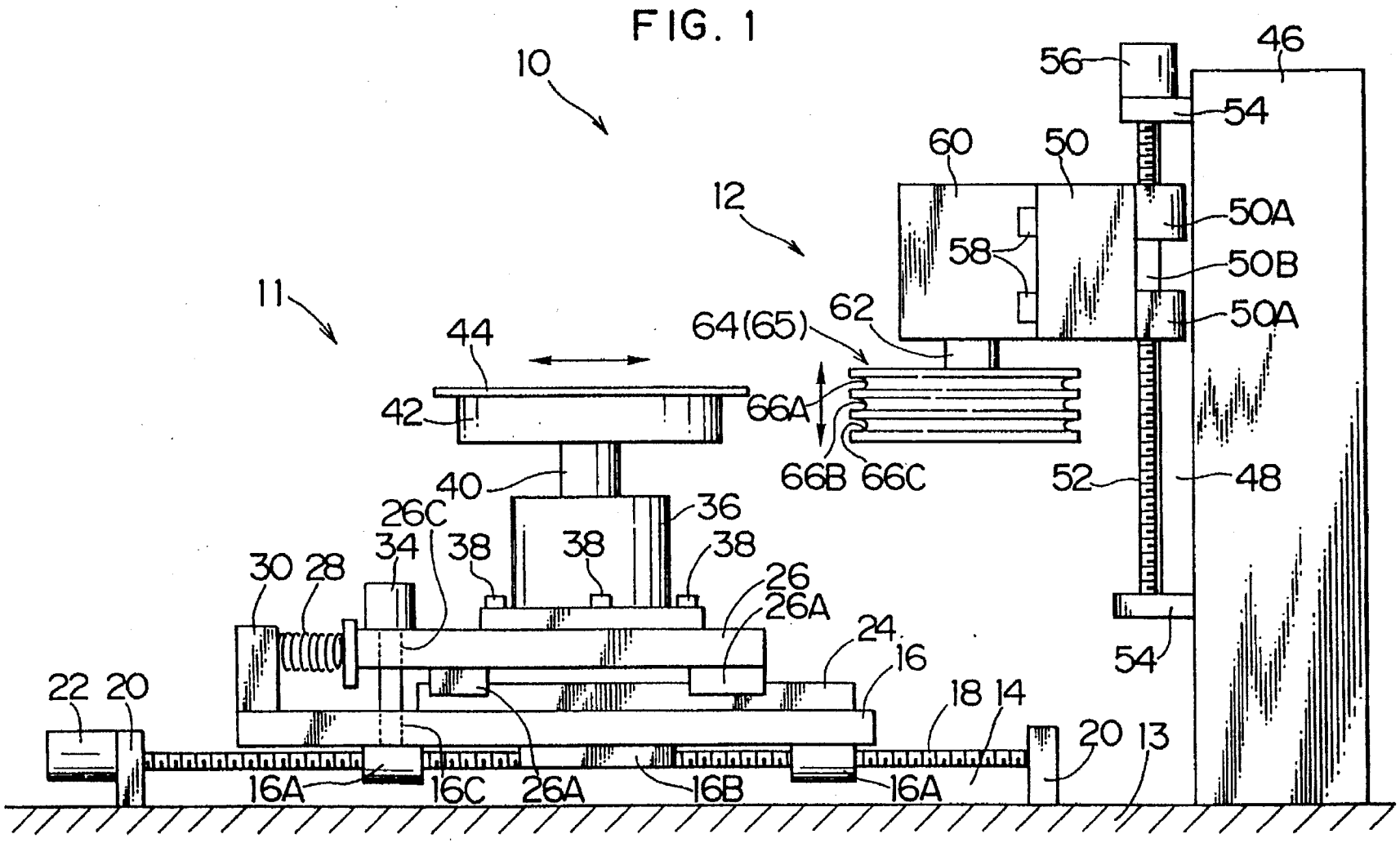
FIG. 1 is a side elevation of a grinding apparatus for a wafer edge according to the present invention.

FIG. 1 is a side elevation of an embodiment of a grinding apparatus for a wafer edge according to the present invention. As shown in the drawing, the grinding apparatus 10 for a wafer edge mainly comprises a wafer feeding means 11 and a grinding means 12. Each means is provided on a base 13, which is arranged horizontally.

The structure of a wafer feeding means 11 will be explained. A pair of guide rails 14 and 14 are arranged on the base 13. A slide stage 16 is slidably supported on the guide rails 14 and 14 by guide grooves 16A, 16A which are formed on the bottom surface of the slide stage 16. And, a nut portion 16B is formed at the bottom surface of the slide stage 16, and the nut portion 16B is engaged with a guide screw 18, which is provided in parallel with the guide rails 14 and 14. Both ends of the guide screw 18 are rotatably supported by supporting members 20 and 20, which are provided close to both ends of the guide rails 14 and 14. A motor 22 for feeding a wafer is connected with one end of the guide screw 18. And, the motor 22 is driven to rotate the ball screw 18, so that the slide stage 16 slides on the guide rails 14 and 14.

A pair of guide rails 24 and 24 are arranged on the slide stage 16, and a slide table 26 for pressurization is slidably supported on the guide rails 24 and 24 by guide grooves 26A, 26A which are formed on the bottom surface of the slide table 26. A motor 36 for rotating a wafer is fixed on the slide table 26 for pressurization with bolts 38, 38, and a wafer table 42 is connected with a rotation shaft 40 of the motor 36 for rotating a wafer.

A spring 28 is provided in such a manner that one end of the spring 28 is connected with the slide table 26 and the other end is connected with a supporting member 30 which is provided on the end of the slide stage 16 so as to act as a pressurization means. When the spring 28 is compressed, a reaction force which corresponds to the compression for the spring 28 acts on the slide table 26 in the right direction of FIG. 1.

Holes 16C and 26C are respectively formed on the slide stage 16 and slide table 26 for pressurization, and a pin 34 is engaged with holes 16C and 26C so that the slide table 26 can be locked to the slide stage 16. The pin 34 and the holes 16C and 26C act as a locking means for the pressurization means so that the pressurization means can be locked.

Next, the structure of a grinding means 12 will be explained. A frame 46 is placed close to one end of guide rails 14 and 14 of the above-mentioned wafer feeding means 11. A pair of guide rails 48 and 48 are vertically provided on the wafer feeding means side of the frame 46. A slider 50 is slidably supported on the guide rails 48 and 48 by guide members 50A, 50A. A nut portion 50B is formed on the back surface of the slider 50, and the nut portion 50B is engaged with a guide screw 52, which is provided in parallel with the guide rails 48 and 48. And, both ends of the guide screw 52 is rotatably supported by supporting members 54 and 54, which are provided on the frame 46, and one end is connected with a motor 56 for moving a grinding wheel. The motor 56 is driven to rotate the ball screw 52, so that the slider 50 can be raised and lowered on the guide rails 48 and 48.

A motor 60 for rotating a grinding wheel is connected with the slider 50 with bolts 58, 58, and a grinding wheel 64 for chamfering or a grinding wheel 65 for polishing is connected with a rotation shaft 62 of the motor 60.

Figure 2:
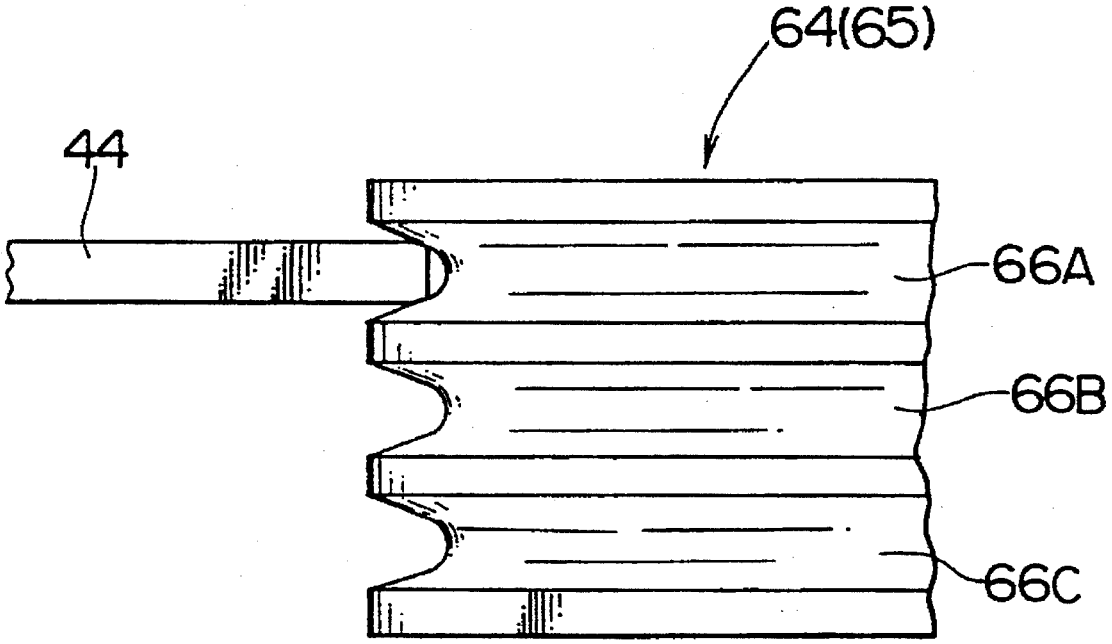
FIG. 2 is an enlarged view showing main parts of an embodiment of a grinding apparatus for a wafer edge according to the present invention.

The grinding wheel 64 and 65 has a cylindrical shape, and it has three tapered grooves 66A, 66B, and 66C which are formed on the peripheral surface of the grinding wheel 64 and 65 respectively. The edge of the wafer 44 contacts the tapered grooves 66A, 66B and 66C, so that upper and lower edges can be ground at one time (refer to FIG. 2). One of the three grooves 66A, 66B and 66C is used for processing. For example, if the groove 66A is abraded, the groove 66B or the groove 66C is used. The grinding wheel 64(65) is attachably and removably connected with the rotation shaft 62 of the motor 60. A grinding wheel 64 for chamfering is attached at the time of chamfering, and a grinding wheel 65 for polishing is attached at the time of polishing. As a result, each work is carried out respectively. Here, for example, a silica-bonded grinding wheel is applied as the grinding wheel 65 for polishing. Therefore, it is possible to carry out the polishing as well as the chamfering with the widely-used water soluble coolant. As a result, abrasive are not required.

Next, an explanation will be given of the operation of the embodiment of the apparatus for processing the wafer edge according to the present invention structured as described above. Now, the control of the grinding apparatus 10 for a wafer edge is performed by the control means, which is not shown in the drawing.

First, an explanation will be given of the chamfering. At the time of chamfering, a grinding wheel 64 for chamfering is used as the grinding wheel. The pin 34 is engaged with holes 16C and 26C, which are respectively formed in the slide table 26 and the slide stage 16, and the slide table 26 for pressurization is fixed to the slide stage 16. As a result, the pressurization means is locked. Then, the wafer is absorbed and fixed on the wafer table 42 after the center of the wafer 44 is located to match the rotational center of the wafer table 42. Then, the motor 22 for feeding the wafer and the motor 56 for moving the grinding wheel are driven to move the slide stage 16 and the slider 50, so that the wafer 44 and the grinding wheel 60 can be located at a predetermined position.

Next, the control means drives the motor 60 for rotating the grinding wheel and the motor 36 for rotating the wafer so as to rotate the grinding wheel 64 and the wafer 44. Then, the motor 22 for feeding the wafer is driven to move the slide stage 16 toward the grinding wheel 64, so that the edge portion of the wafer 44 can contact the tapered groove 66A of the grinding wheel 64. The moving distance of the slide stage 16 is predetermined, and the control means moves the slide stage 16 up to a predetermined position while pressing the wafer edge against the groove 66A of the grinding wheel 64. As a result, the edge of the wafer 44 is chamfered by a predetermined amount. When the chamfering for the wafer 44 is completed, the control means drives the motor 22 to move the slide stage 16 up to a position at which the slide stage 16 is located at the time of a starting, so that the wafer 44 is retracted from the grinding wheel 64. Then, the control means stops driving the motor 36 for rotating the wafer and the motor 60 for rotating the grinding wheel. After that, the chamfered wafer is taken out from the wafer table 42.

Next, an explanation will be given of the polishing for the chamfered portion of the wafer 44.

The pin 34, which has been engaged with the hole 26C of the slide table 26 and the hole 16C of the slide stage 16 during chamfering, is removed so that the slide table 26 can slide on the slide stage 16. A grinding wheel 65 for polishing is used as the grinding wheel.

First, the wafer 44 being chamfered is absorbed and fixed on the wafer table 42 after the center of the wafer 44 is located to match the rotation center of the wafer table. Then, the control means drives the motor 22 for feeding the wafer and the motor 56 for moving the grinding wheel to move the slide stage 16 and the slider 50, so that the wafer 44 and the grinding wheel 65 can be located at a predetermined position.

Next, the control means drives the motor 60 for rotating the grinding wheel and the motor 36 for rotating the wafer so that the grinding wheel 65 and the wafer 44 can be rotated. The control means drives the motor 22 for feeding the wafer to move the slide stage 16 toward the grinding wheel 65, and contacts the chamfered portion of the wafer 44 with the tapered groove 66A of the grinding wheel 65 for polishing.

At this time, the moving distance of the slide stage 16 is predetermined to be larger than that at the above described chamfering (for example, by 5–10 mm), so that the slide table 26 moves toward an opposite side of the grinding machine. Accordingly, the spring 28 connected with the slide table 26 for pressurization is compressed, and then, a reaction force which corresponds to the compression of the spring 28 acts on the slide table 26 as a pressure (this pressure is preferred to be 1–4 $kg/cm^2$). As a result, the wafer 44 is pressed against the tapered groove 66A of the grinding wheel 65 with a prescribed pressure, and the chamfered portion of the wafer 44 is polished. When the polishing is completed, the motor 22 is driven to move the slide stage 16 up to a position at which the slide stage 16 is located at the time of the starting. Then, the wafer 44 is retracted from the grinding wheel 65. After this, the control means stops driving the motor 36 for rotating the wafer and the motor 60 for rotating the grinding wheel. Then, the polished wafer is taken out from the wafer table 42.

As described above, according to the grinding apparatus for a wafer edge of this embodiment, the chamfering and the polishing for the wafer edge can be easily performed in one apparatus without using the mechano-chemical abrasive, etc., which cannot be easily handled.

Moreover, the polishing can be performed in one apparatus as well as the chamfering without a special device (for example, a device for supplying the abrasive, etc.). Therefore, the apparatus can be simplified and manufacturing and maintenance cost of an equipment and the like can be reduced.

Furthermore, by adjusting the moving distance of the slide stage 16, it is possible to adjust the pressure for the contact between the wafer 44 and the grinding wheel 65 for polishing, which is generated by the pressurization means. As a result, the life of the grinding wheel can be elongated.

In this embodiment, the pressurization means is constructed in such a manner that the one end of the slide table 26 is connected with one end of the slide stage 16 by means of the spring 28. That is, the wafer 44 is pressed against the grinding wheel 65 for polishing by the reaction force of the compressed spring 28. However, the present invention is not limited to this, and the pressurization means can be also employed as shown in FIG. 3 and FIG. 4.

Figure 3:
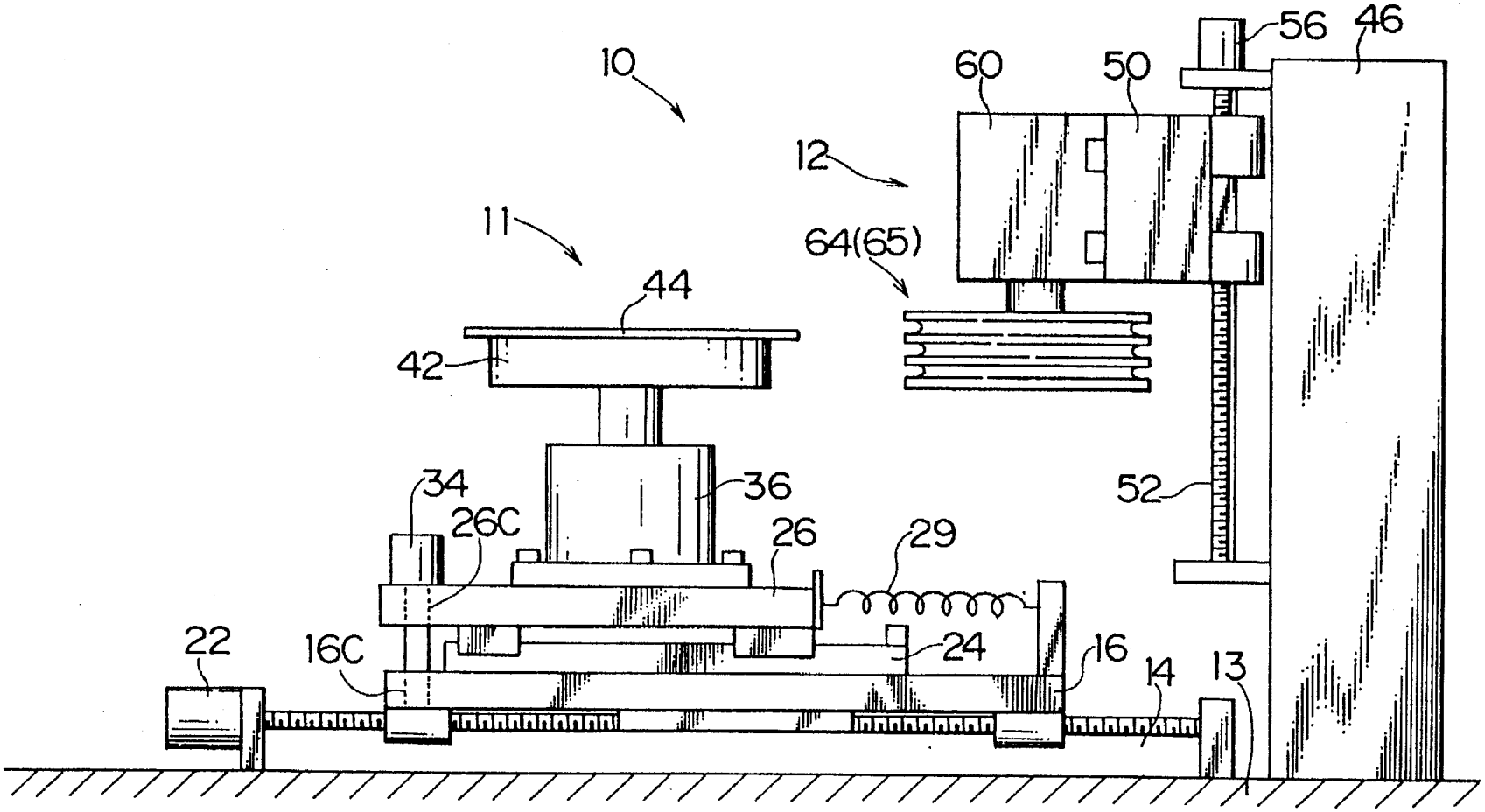
FIG. 3 is an explanatory view explaining the case that a tension spring is used for a pressurization mechanism in an embodiment of a grinding apparatus for a wafer edge according to the present invention.

In FIG. 3, the spring 29 is arranged at the side of grinding wheel (that is, the opposite side of the apparatus of FIG. 1). The wafer 44 is pressed against the grinding wheel 65 for polishing by the prescribed pressure which corresponds to tension force of the spring 29.

Figure 4:
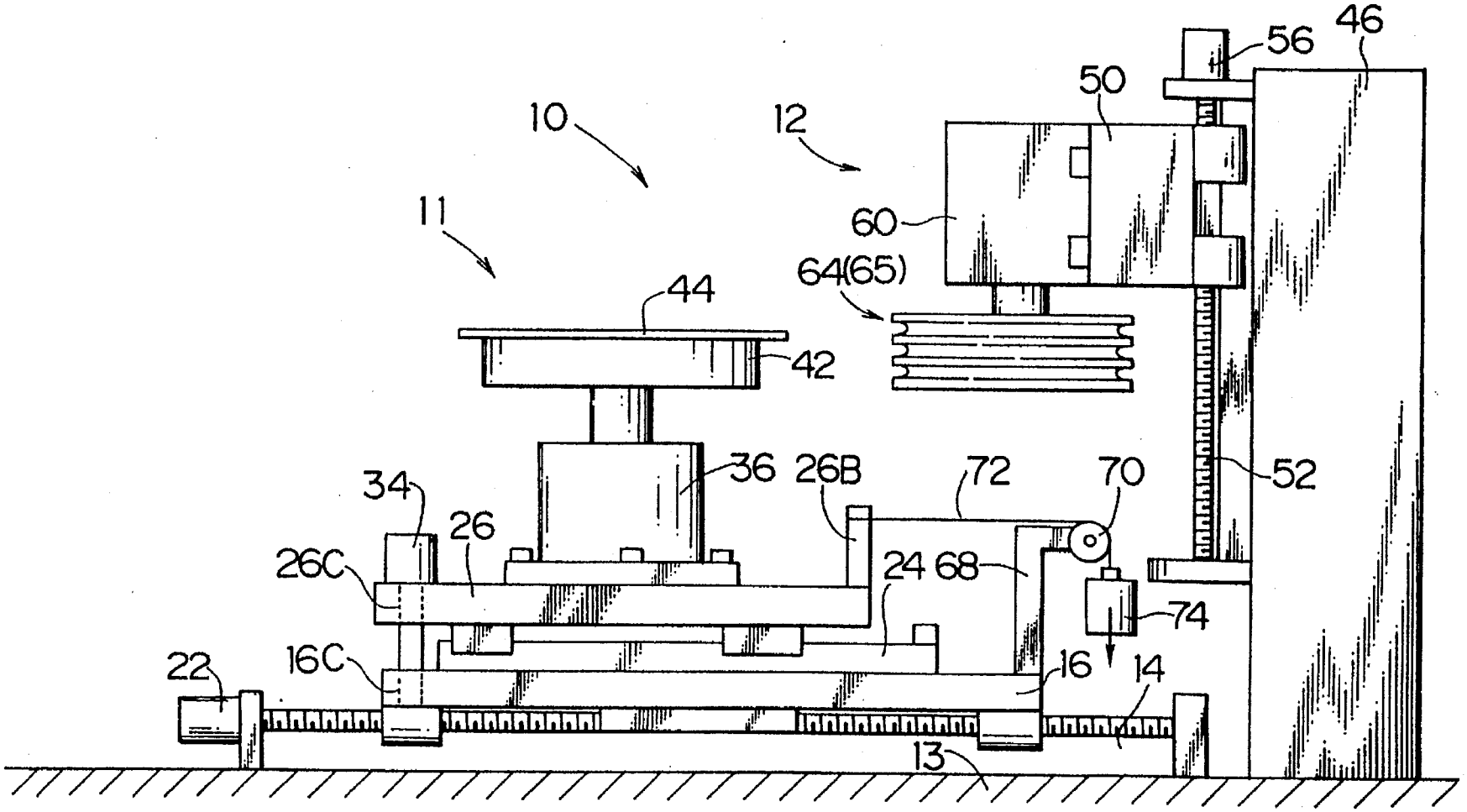
FIG. 4 is an explanatory view explaining the case that a weight is used for a pressurization mechanism in an embodiment of a grinding apparatus for a wafer edge according to the present invention.

On the other hand, in FIG. 4, a wire supporting portion 26B is formed at the end of the grinding wheel side of the slide table 26 for pressurization, and a guide roller 70 for guiding a wire is provided at the end of the grinding wheel side of the slide stage 16 with a bracket 68. One end of a wire 72 is fixed at the wire supporting portion 26B, and a weight 74 of a predetermined weight is attached at the other end of the wire 72 via the guide roller 70. As a result, the wafer 44 is pressed against the grinding wheel 65 for polishing by the pressure, which is generated by means of the weight 74. The adjustment of the pressure is performed by changing the weight 74.

Figure 5:
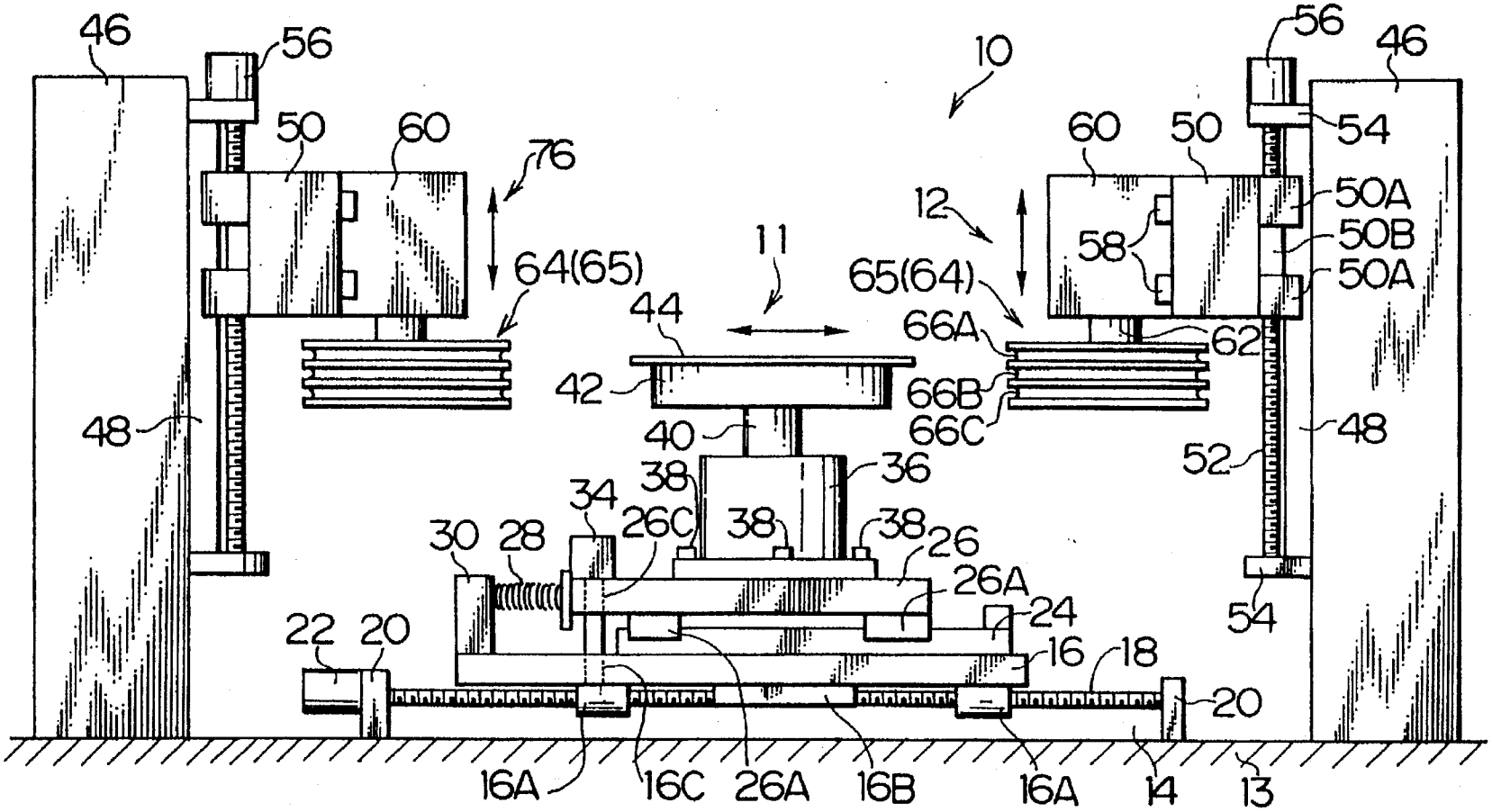
FIG. 5 is an explanatory view explaining an embodiment of a grinding apparatus for a wafer edge according to the present invention; and, FIG. 6 is an explanatory view explaining an embodiment of a grinding apparatus for a wafer edge according to the present invention.
Figure 6:
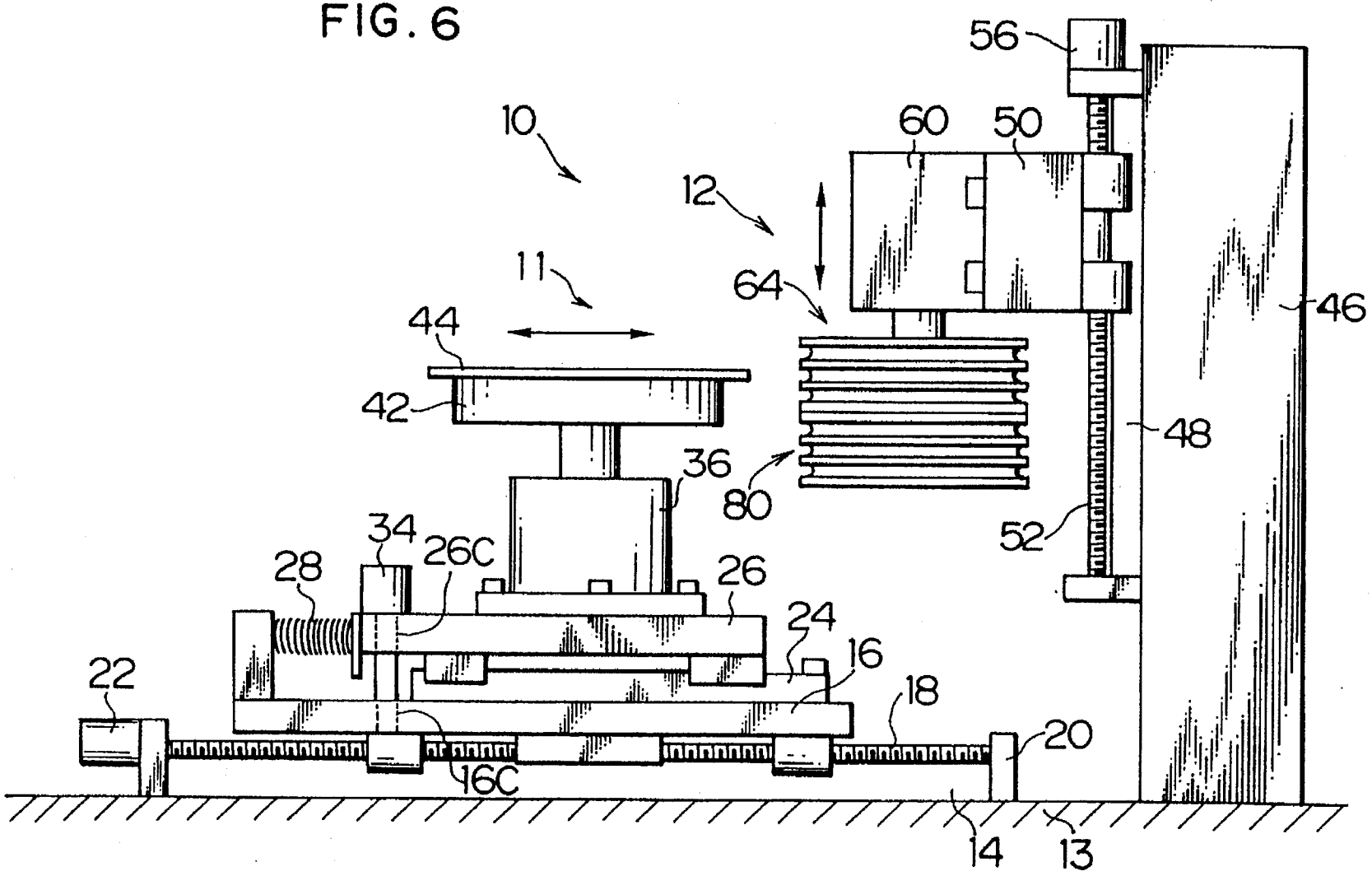

In this embodiment, the chamfering and the polishing were separately explained, but the chamfering and the polishing can be performed in series by the apparatus constructed as shown in FIGS. 5 and 6.

As shown in FIG. 5, another grinding means 12 is arranged on the left side of the grinding apparatus for wafer edge of FIG. 1. That is, two grinding means are arranged to face each other, and one wafer feeding means is arranged between two grinding means. Here, the grinding means arranged in the left side of FIG. 5 is called a first grinding means 76 and the means on the right side of FIG. 5 is called a second grinding means 12. The first and second grinding means have the same structure as the grinding means 12 of FIG. 1, so the same reference numerals are put on the same parts as those previously described in FIG. 1, and an explanation of those is omitted here. A grinding wheel 64 for chamfering is connected with the motor 60 for the rotating the grinding wheel of the first grinding means 76 and a grinding wheel 65 for polishing is connected with the motor 60 of the second grinding means 12.

In the grinding apparatus for wafer edge of FIG. 5, first, the wafer is moved toward the first grinding means 76 side in the condition that the pressurization means is kept locked. Then, the chamfering for the wafer 44 is performed with the grinding wheel 64 for chamfering. Next, the wafer 44 is moved toward the second grinding means 12 side. The pin 34 is removed so as to release the lock for the pressurization means. Then, the polishing for the wafer 44 is performed with the grinding wheel 65 for polishing.

As a result, it is not necessary to exchange a grinding wheel at the time of the chamfering and the polishing. Further, the chamfering and the polishing can be performed in one apparatus. Moreover, it is also possible to arrange the grinding wheel 65 for polishing in the first grinding means 76 side and the grinding wheel 64 for chamfering in the second grinding means 12 side. In this case, the spring 28 is expanded when the wafer is polished.

Furthermore, in FIG. 6, the another grinding wheel 80 is provided below the grinding wheel 64 of the grinding apparatus 10 for the wafer edge of FIG. 1. The grinding wheel 64 is used for chamfering and the grinding wheel 80 is used for polishing. The chamfering and the polishing for the wafer are performed in series by raising and lowering the slider 50, therefore, it is not required to exchange a grinding wheel.

In the above described embodiments according to the present invention, the chamfering and the polishing for the wafer edge are carried out in one apparatus. Therefore, the manufacturing and maintenance cost of equipment and the like can be reduced, and it is also possible to make better use of the space in the factory.

Moreover, instead of special abrasive, a widely-used water soluble coolant is applied in the present invention. As a result, the polishing can be easily performed and the apparatus can be simplified because the equipments for the special abrasive are not required.

It should be understood, however, that there is not intention to limit the invention to the specific forms disclosed, but on the contrary, the invention is to cover all modifications, alternate constructions and equivalents falling within the spirit and scope of the invention as expressed in the appended claims.

What is claimed is:

1. An apparatus for grinding and polishing a wafer edge, in which a rotatable wafer table and a rotatable grinding shaft are constructed in such a manner as to be capable of moving up and down and horizontally with regard to each other, a wafer is fixed to said wafer table and at least one rotatable wheel is connectable to said grinding shaft for grinding and polishing said wafer, said wafer table and said at least one wheel capable of being moved closer to each other to permit grinding and polishing of said water edge, said grinding and polishing apparatus comprising:

pressurization means provided at one of said wafer table and said at least one rotatable wheel for pressing said wafer edge against said at least one rotatable wheel by a predetermined force;

locking means for locking said pressurization means so as to prevent said force of said pressurization means from acting; and wherein said locking means is locked when said wafer edge is ground by said at least one rotatable wheel to form a chamfered wafer edge, and said locking means being released when said chamfered wafer edge is polished by said rotatable wheel.

2. The grinding and polishing apparatus for a wafer edge according to claim 1, wherein said at least one rotatable wheel includes a silica-bonded grinding wheel for polishing the wafer edge.

3. The grinding and polishing apparatus for a wafer edge according to claim 1, wherein said pressurization means is a compression spring.

4. The grinding and polishing apparatus for the wafer edge according to claim 1, wherein said pressurization means is a tension spring.

5. The grinding and polishing apparatus for the wafer edge according to claim 1, wherein said pressurization means is a weight member connected to a slide table via a wire, said slide table sliding said wafer table with regard to said at least one rotatable wheel, and said weight member pressing said wafer edge against said at least one rotatable wheel by weight thereof so as to make said force variable.

6. The grinding apparatus for a wafer edge according to claim 1, wherein said at least one rotatable wheel includes a chamfering grinding wheel and a polishing grinding wheel formed integrally together.

* * * * *